US005556196A

United States Patent [19]

Lin

[11] Patent Number: 5,556,196

[45] Date of Patent: Sep. 17, 1996

[54] CEMENT CHARGING, MIXING AND POURING APPARATUS ATTACHED ON A HEAVY DUTY MACHINE

[76] Inventor: Yeong-sen Lin, No. 441, Hsingho Rd., Salu Chen, Taiwan

[21] Appl. No.: 517,559

[22] Filed: Aug. 21, 1995

[51] Int. Cl.[6] ..... B28C 5/12; B28C 7/04

[52] U.S. Cl. ..... 366/18; 366/26; 366/41; 366/65; 366/66; 366/67; 366/141; 366/154.1; 366/156.2; 366/192

[58] Field of Search ..... 366/18–21, 26, 366/35, 38, 41, 64–67, 68, 141, 156.1, 156.2, 155.1, 181.1, 181.3, 182.3, 183.1, 192, 193, 309, 312, 320, 606

[56] References Cited

U.S. PATENT DOCUMENTS

| | | | |
|---|---|---|---|
| 1,606,082 | 11/1926 | Kirchhoff | 366/141 |
| 2,547,787 | 4/1951 | Siebring et al. | 366/26 |
| 2,706,623 | 4/1955 | Styes | 366/26 |
| 4,075,711 | 2/1978 | Hall | 366/64 X |
| 4,268,174 | 5/1981 | Falardeau | 366/606 X |
| 4,588,299 | 5/1986 | Brown et al. | 366/18 X |
| 4,660,987 | 4/1987 | Robinson | 366/67 |
| 4,963,031 | 10/1990 | Brown | 366/141 X |

FOREIGN PATENT DOCUMENTS

| | | | |
|---|---|---|---|
| 623743 | 8/1978 | U.S.S.R. | 366/41 |

*Primary Examiner*—Charles E. Cooley
*Attorney, Agent, or Firm*—Schmeiser, Olsen & Watts

[57] ABSTRACT

A cement mixer pivotably mounted on a linkage of an arm assembly of a heavy-duty machine, for example, an excavator or a shovel. The cement mixer includes a barrel, an agitator assembly rotatably mounted on the barrel and used to agitate materials to be mixed in the barrel, a mounting beam connecting the barrel to the linkage, a funnel mounted on the mounting beam and positioned above the barrel and used to receive the materials to be mixed and a weight measuring device provided on the mounting beam and used to measure the weight of the materials received in the funnel.

14 Claims, 13 Drawing Sheets

CEMENT CHARGING, MIXING AND POURING APPARATUS ATTACHED ON A HEAVY DUTY MACHINE

FIELD OF THE INVENTION

The present invention is related to a cement mixer, particularly to a cement mixer which can shovel the materials to be mixed, i.e., sand or gravel, into the mixer. Furthermore, the mixer is adapted to be mounted on a heavy-duty machine, for example, an excavator or a shovel to enhance the mobility of the mixer to facilitate its operation: to load the necessary materials into the mixer and to pour the mixed concrete to a casting position.

BACKGROUND OF THE INVENTION

On construction sites, concrete can be supplied by three ways: the first is that workers mix cement, sand, gravel and water on a board or plate manually using appropriate tools, for example, a shovel the second is that the concrete is prepared by a cement mixer and then it is poured into a suitable apparatus, for example, a wheelbarrow whereby the concrete can to be delivered to a casting position and the third is that the concrete is pre-prepared in a mixing plant and transported to the construction site by mixer lorries and finally delivered to the casting position by concrete delivery pumps and pipes.

All of the above-mentioned ways to provide concrete have their respective disadvantages. In particular, the first and second ways are laborious and have a low efficiency of operation, and the third, although more efficient to operate, requires a high expenditure for the equipment.

SUMMARY OF THE INVENTION

It is an objective of the present invention to provide a cement mixer which can have a high efficiency of operation to mix the cement and pour the mixed concrete to a casting position and a low cost concerning the equipment.

A further objective of the present invention is to provide a cement mixer adapted to be mounted on a heavy-duty machine, for example, an excavator or a shovel to facilitate the mobility of the mixer.

It is a further objective of the present invention to provide a cement mixer which can shovel the materials to be mixed, for example, sand and gravel into the mixer.

It is yet a further objective of the present invention to provide a cement mixer which can measure the weight of the material to be mixed and remove the superfluous material.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
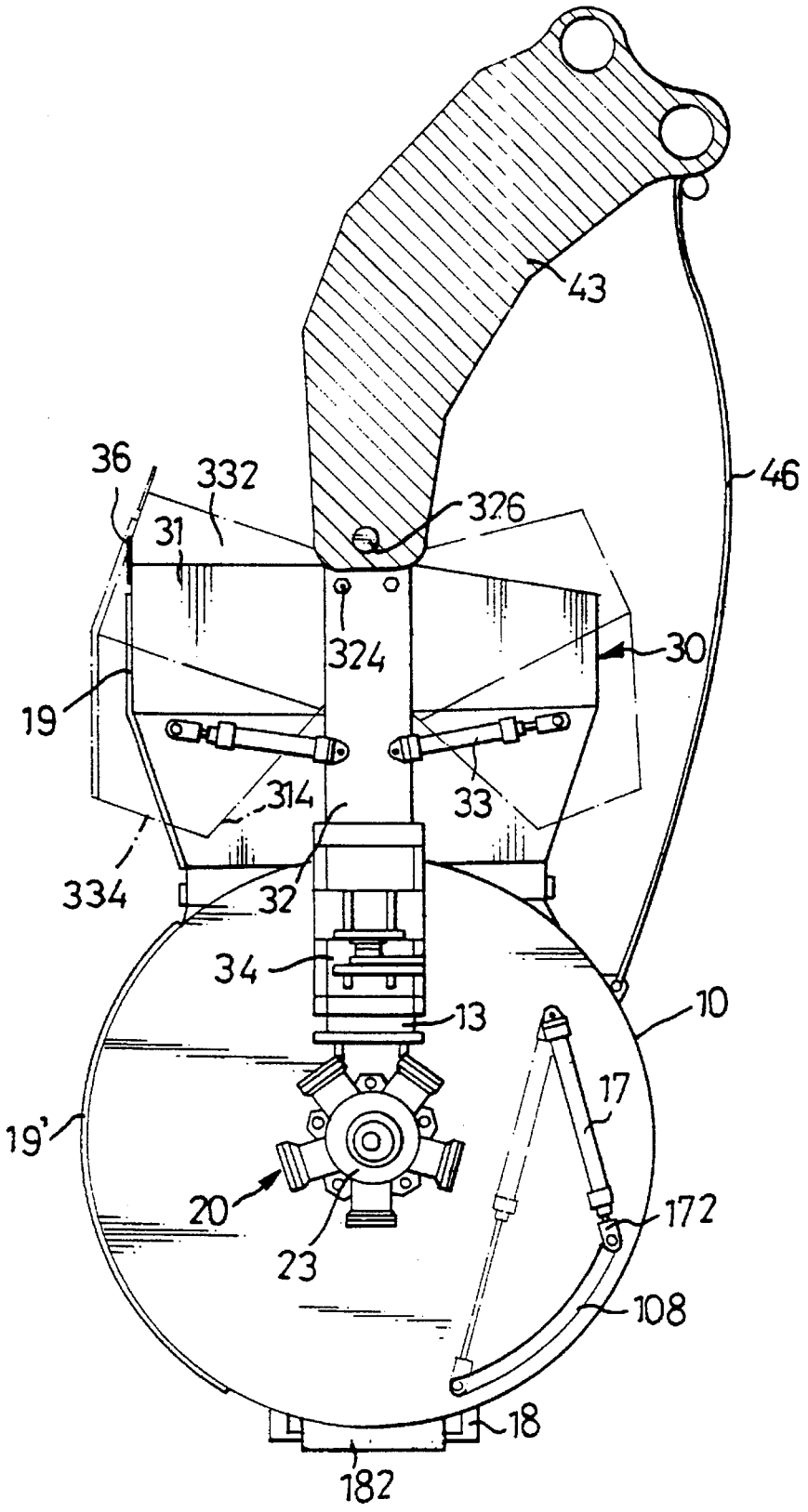
FIG. 1 is a side elevational view of a cement mixer in accordance with the present invention wherein the mixer is mounted on a linkage of an arm assembly of a heavy-duty machine, for example, an excavator or a shovel.
Figure 2:
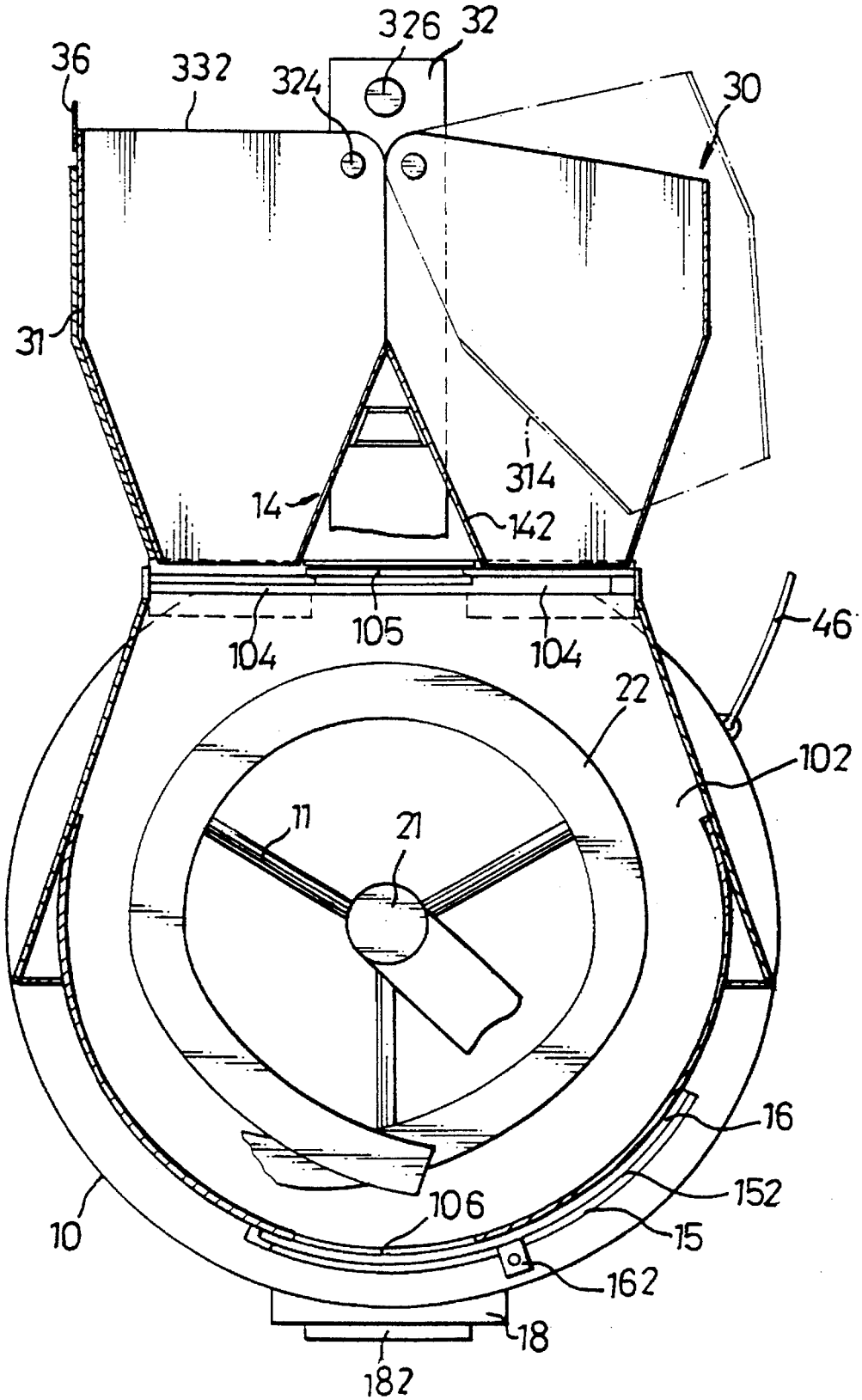
FIG. 2 is a side cross-sectional view showing the inner structure of the present cement mixer.
Figure 3:
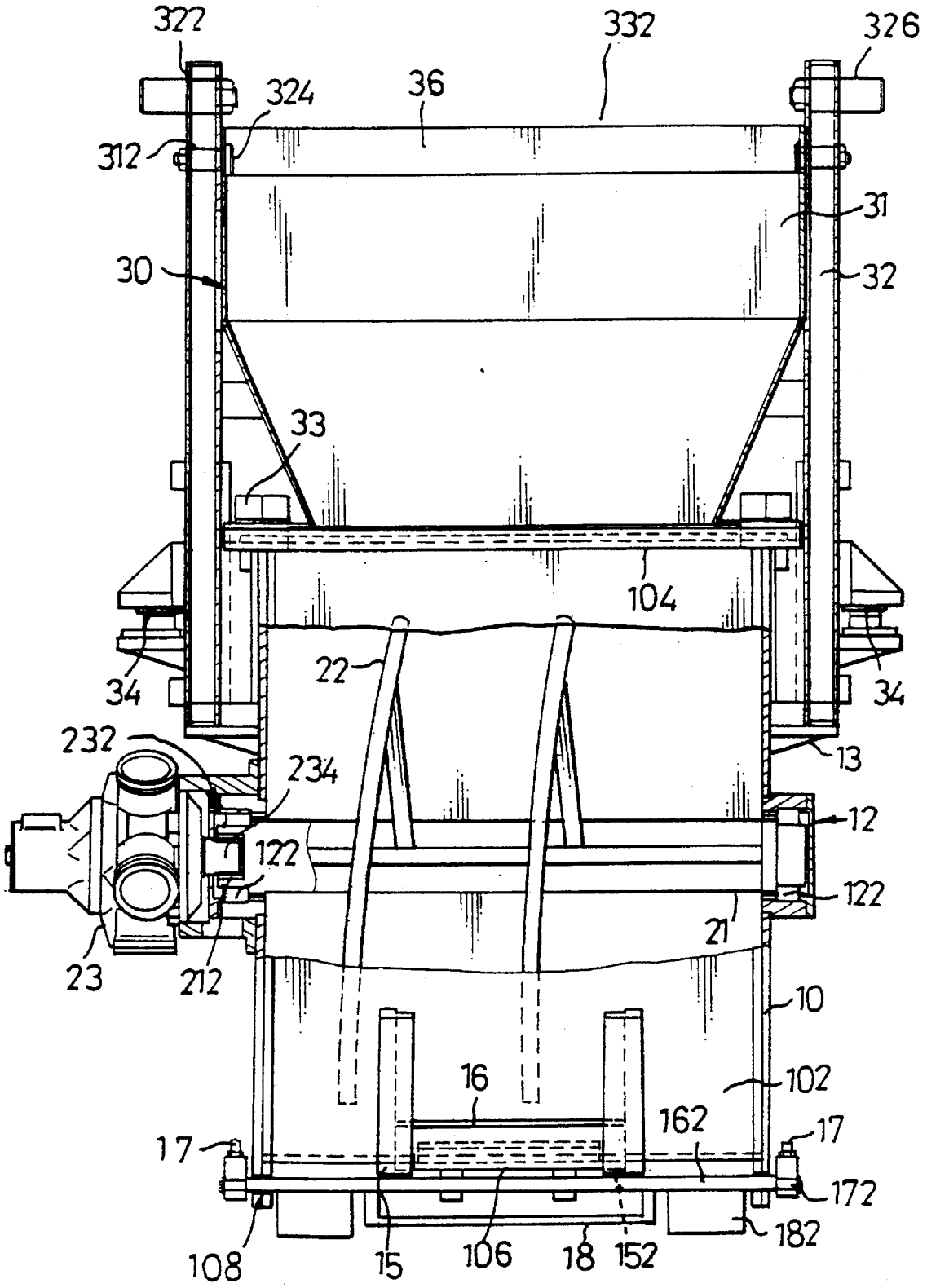
FIG. 3 is a front elevational, partly cross-sectional view of the present cement mixer.

Now please refer to FIGS. 1 to 4, the present cement mixer consists mainly of a pair of mounting beams 32 pivotably connected to a linkage 43 of an arm assembly of a heavy-duty machine, for example, an excavator 40 as shown in the present application, a barrel 10 mounted on the beams 32 through mounting seats 13, a weight measuring device 34 mounted between the beams 32 and the mounting seats 13, a charging assembly 30 pivotably mounted on the beams 32 and located above the barrel 10 and an agitator assembly 20 rotatably mounted on the barrel 10.

The beams 32 are pivotably mounted on the linkage 43 through a pair of bolts 326 extending through holes 322 of the beams 32 and the linkage 43. The charging assembly includes a pair of funnels 31; each funnel 31 is pivotably mounted on the beams 32 by a pair of bolts 324 extending through a wall of the funnel 31 and holes 312 of the beam 32.

Each of the funnels 31 includes an inlet 332 for charging the materials to be mixed, for example, sand, water, cement and gravel into the funnels 31 and an outlet 334 for discharging the m'aterials into the barrel 10 or outside of the present cement mixer when the materials are superfluous. The funnels located on the left side of the drawings is equipped with a shoveling plate 36 to facilitate the shoveling operation of the present cement mixer and a protective plate 19 which is made of an abrasion-resistant material to protect the left-side funnel 31. Furthermore, the left side of the barrel 10 is also equipped with a protective plate 19' to protect the barrel 10 from abrasion when the present cement mixer is operated to shovel sand or gravel into the funnels 31.

Two pairs of hydraulic cylinders 33 are mounted to respectively connect the funnels 31 and the beams 32 so that when the cylinders 33 are extended by a fluidic force from the excavator 40, the funnels 31 can have a pivotable movement about the bolts 324 to reach a position as shown by the phantom lines of FIG. 1.

A steel rope 46 connects the barrel 10 at a right side of the drawings to a mechanism (not shown) which can exert a pulling force on the steel rope 46 to pivot the present cement mixer about the bolts 326.

A pair of cushioning pads 182 and a supporting base 18 are mounted on a bottom of the barrel 10 to facilitate the present cement mixer being supported on a ground.

A driving motor 23 is mounted on a side of the barrel 10 and receives power from the excavator 40 to drive the agitator assembly 20 to rotate. The agitator assembly 20 includes a pair of bearing carriers 12 mounted on the barrel 10, a pair of bearings 122 mounted on the carrier 12, a shaft 21 mounted on the bearings 122, and a helical blade 22 fixed attached on the shaft 21 to rotate therewith. The rotating force from the motor 23 is transmitted to the shaft 21 through a speed reduction mechanism 232 and engaging portions 234 and 212 of the mechanism 232 and the shaft 21, respectively. The blade 22 is connected to the shaft by three ribs 11 equally spaced from each other. Thus, when the shaft 21 is driven by the motor 23, the blade 22 will rotate therewith.

An accommodating chamber 102 is defined in the barrel 10 to receive the material to be mixed to be agitated by the blade 22. The chamber 102 has two upper openings 104 for receiving the material to be mixed from the charging assembly 30 and a bottom opening 106 to discharge the concrete that has been completely mixed. A first valve 105 and a second valve 16 are provided to respectively control the opening or closing of the openings 104 and 106. Each of the openings 104 and 106 is provided with a seal (not shown) around the openings to prevent a leakage therefrom.

A pair of L-shaped guiding rails 14 are provided beside the second valve 16 and each defines a guiding channel 152 engaging with a die of the second valve 16 for the second valve 16 to have a sliding movement thereon. One of the sides of the second valve 16 further has a part formed with an ear 162 at its end and projecting therefrom to extend through an arcuate guiding slot 108 defined on a side of the barrerl 10. A hydraulic cylinder 17 is pivotally mounted on the side of the barrel 10 where the arcuate slot 108 is defined. The hydraulic cylinder 17 has a piston which defines a connecting lug 172 on an end thereof. The lug 172 is fixedly connected with the ear 162 of the second valve 16 to slide along the guiding rails 15 thereby to close the bottom opening 106.

At the top of the barrel 10, there is provided a reinforcing beam 14 integrally formed therewith. The beam 14 has a triangle cross-section to have two slanted sides 142. The beam 14 extends along a length of the barrel 10 and fixedly connects with the mounting beam 32 by its two ends to reinforce connecting strength between the barrel 10 and the beam 32 and rigidity of the present cement mixer. The funnels 31 have inner edges 314 corresponding to the slanted sides 142. When the cylinders 33 are retracted to prepare charging material to be mixed into the chamber 102, the inner edges 314 will seat respectively on the slanted sides 142 thereby to help the outlets 334 of the funnels 31 to be aligned with the upper openings 104.

Figure 4:
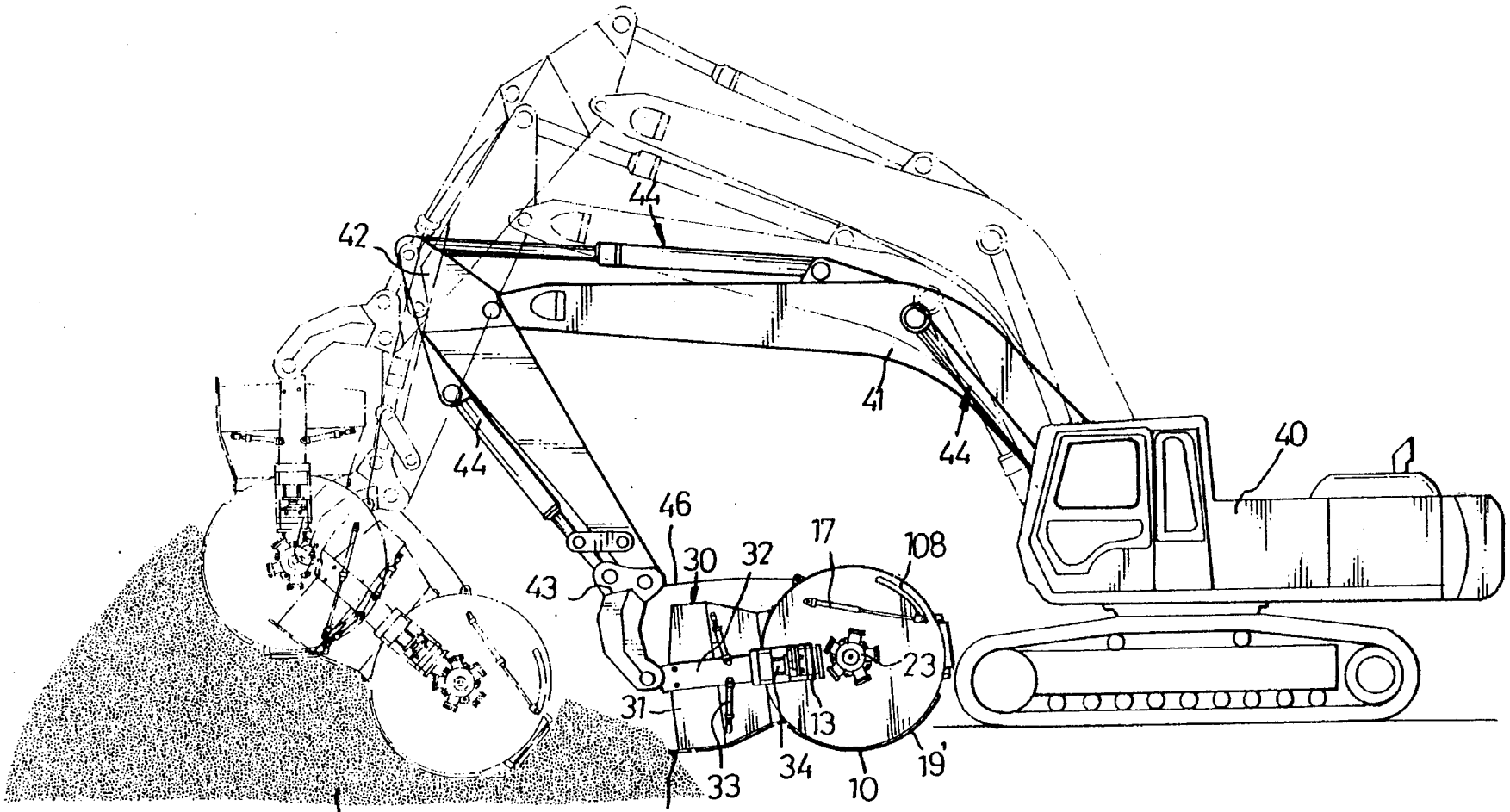
FIG. 4 is a side view showing that the present cement mixer is mounted on an excavator and performs an action to shovel a heap of sand.

Now particularly refer to FIG. 4 which shows that the present cement mixer is mounted on an end of an arm assembly of the excavator 40 and is operated to shovel a heap of sand 50 to load the sand into the funnels 31. The arm assembly of the excavator 40 includes three hydraulic cylinders 44, a rear arm 41, a front arm 42 and the linkage 43 which are respectively controlled by the hydraulic cylinders 44. To begin the shoveling, the steel rope 46 is pulled to rotate the present cement mixer to a horizontal orientation as shown by the solid lines; then, as indicated by the phantom lines, the arm assembly is operated with a known manner of the operation of the excavator 40 to shovel the sand 50 into the funnels 31.

Figure 5:
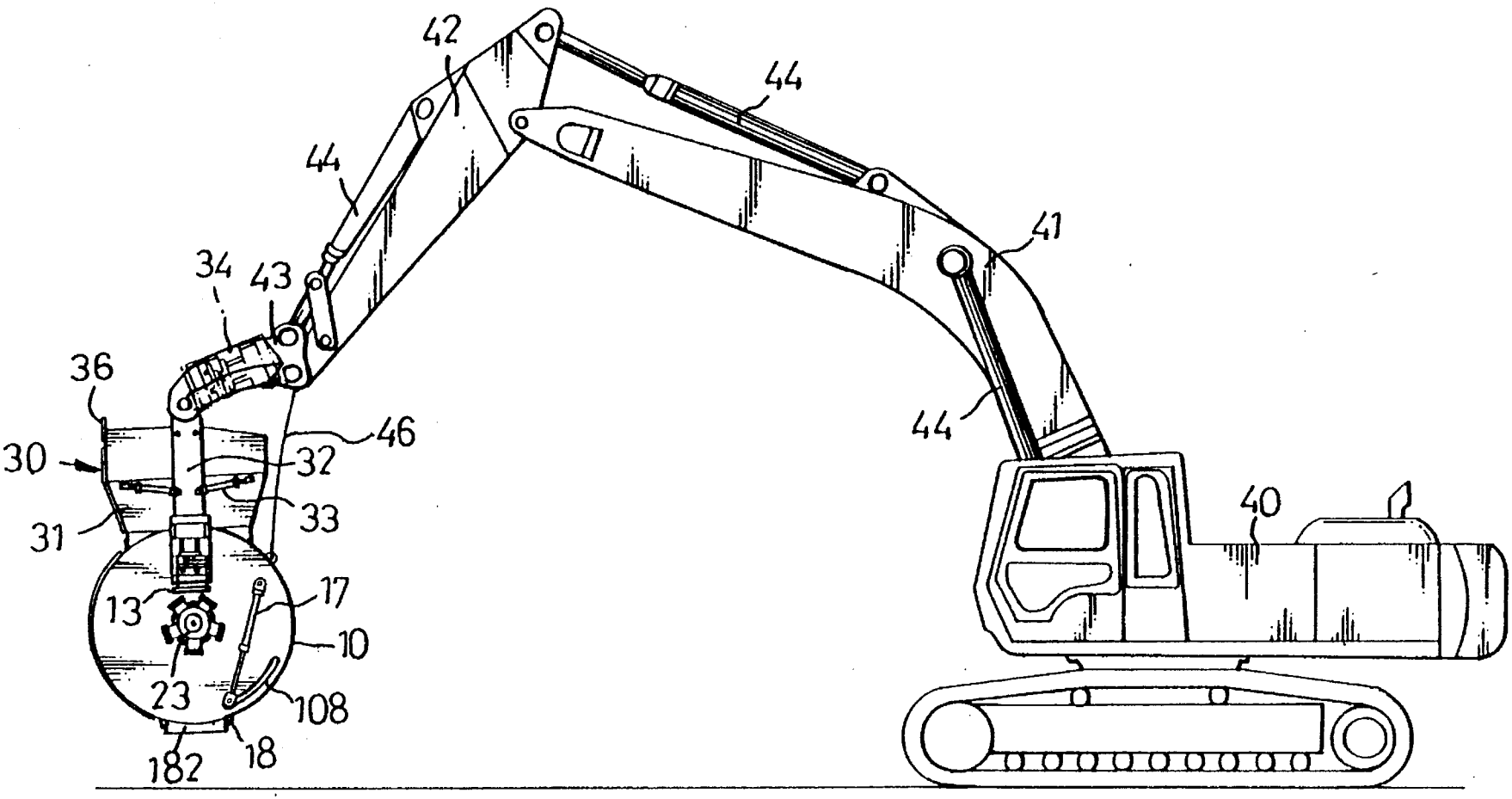
FIG. 5 is a view similar to FIG. 4 but showing that the present cement mixer is operated to measure the weight of the sand as loaded in FIG. 4.

Now refer to FIG. 5, when the arm assembly has completed the shoveling of the sand 50 into the funnels 31 and the present cement mixer has reached the shown vertical position, the weight measuring device 34, which is located between the mounting seat 13 and the mounting beam 32, is operated to measure the weight of the sand. The force exerted by the weight of the sand now is substantially acting on the barrel 10. Here, the weight measuring device 34 could be a mechanical or electronic type. However, in the present invention, an electronic weight measuring device is preferred. As shown by the phantom lines, it can be easily understood by those skilled in the art that it is also possible to mount the weight measuring device 34 on the linkage 43 to measure the weight of the sand.

Figure 6:
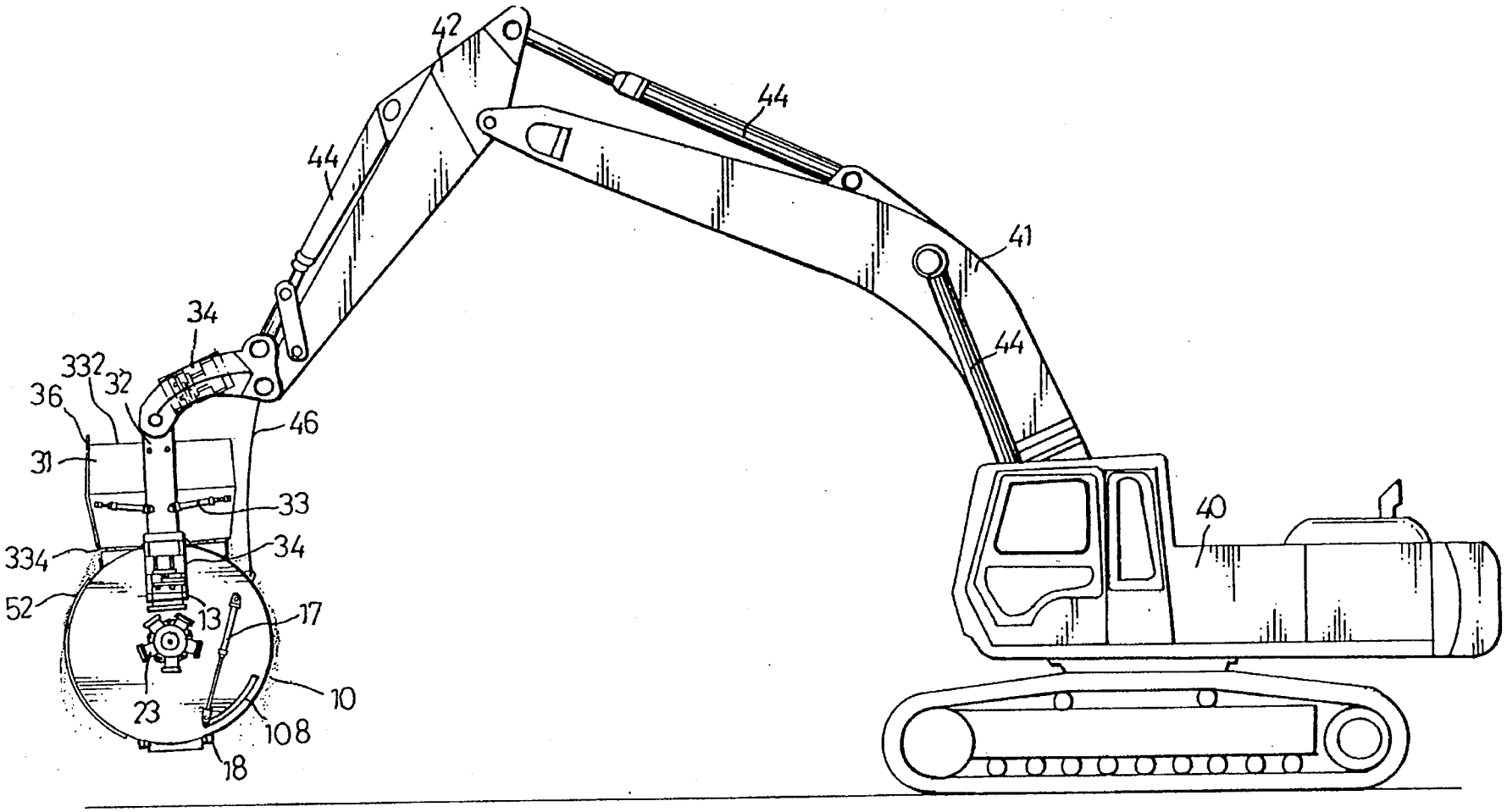
FIG. 6 is a view similar to FIG. 4 but showing that a pair of funnels of the present cement mixer are opened to evacuate superfluous sand from the funnels.

Now referring to FIG. 6, when the weight of the sand loaded into the funnels 31 has been measured and is found to exceed a predetermined value, the funnels 31 are slightly opened by the driving of the cylinders 33 to evacuate the superfluous sand from the funnels 31. When the predetermined value of weight of the sand is reached, as monitored by the weight measuring device 34, the funnels 31 are closed and then the first valve 105 is driven to open the top openings 104 to allow the sand to fall into the accommodating chamber 102. Then, the top openings 104 are closed again.

Figure 7:
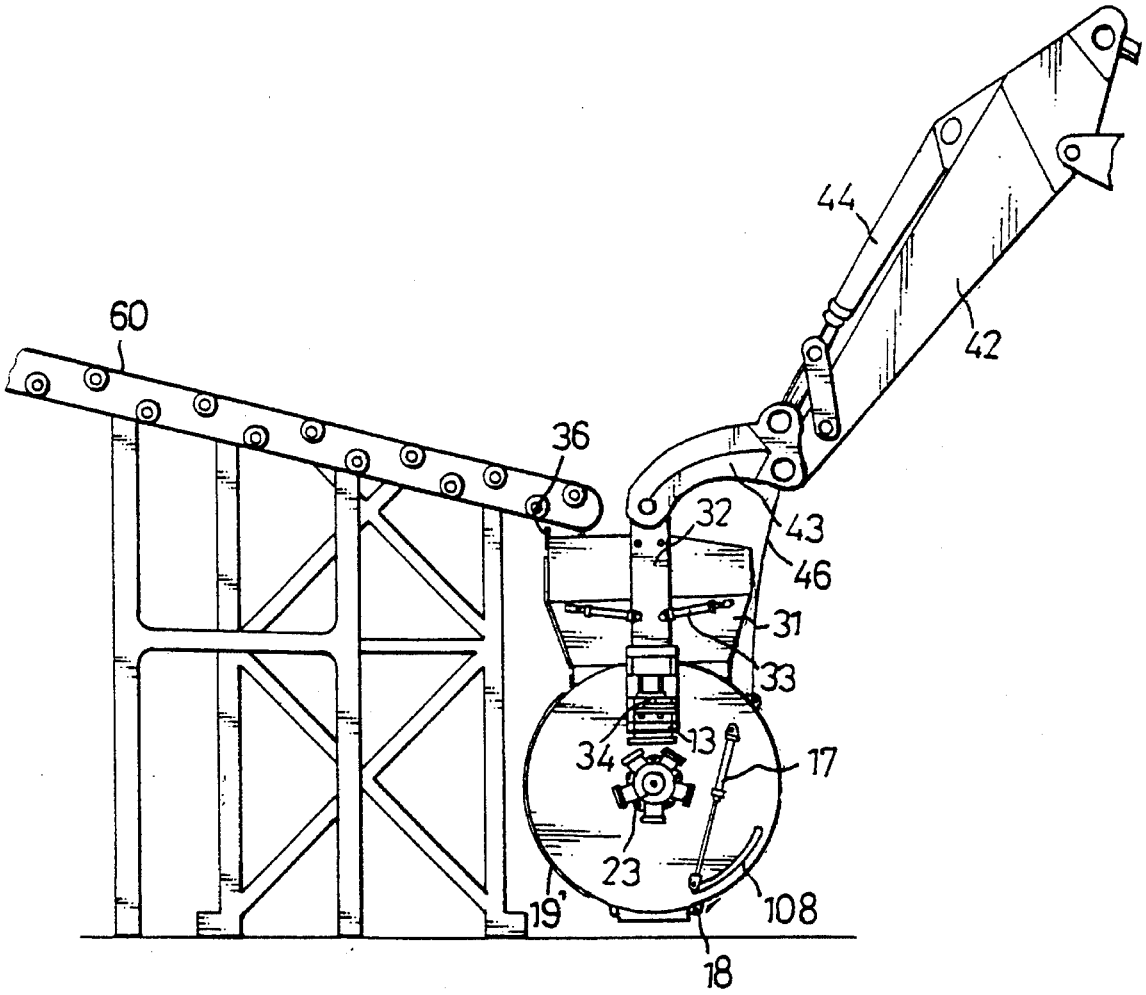
FIG. 7 is a side view showing that the present cement mixer is moved below a belt conveyor to receive gravel therefrom.

Now referring to FIG. 7, after the sand is loaded into the present cement mixer, the excavator 40 is moved to a gravel supplying site to receive gravel from a belt conveyor 60. When charging the gravel, the present cement mixer is positioned in a vertical orientation so that the weight measuring device 34 can constantly monitor the weight of the gravel loaded into the funnels 31. Once a predetermined amount of gravel has been loaded into the funnels 31, the belt conveyor 60 is stopped to pause the charging of the gravel. Then, as mentioned above, the first valve 105 is driven to open the top openings 104 to allow the gravel to fall into the accommodating chamber 102.

Figure 8:
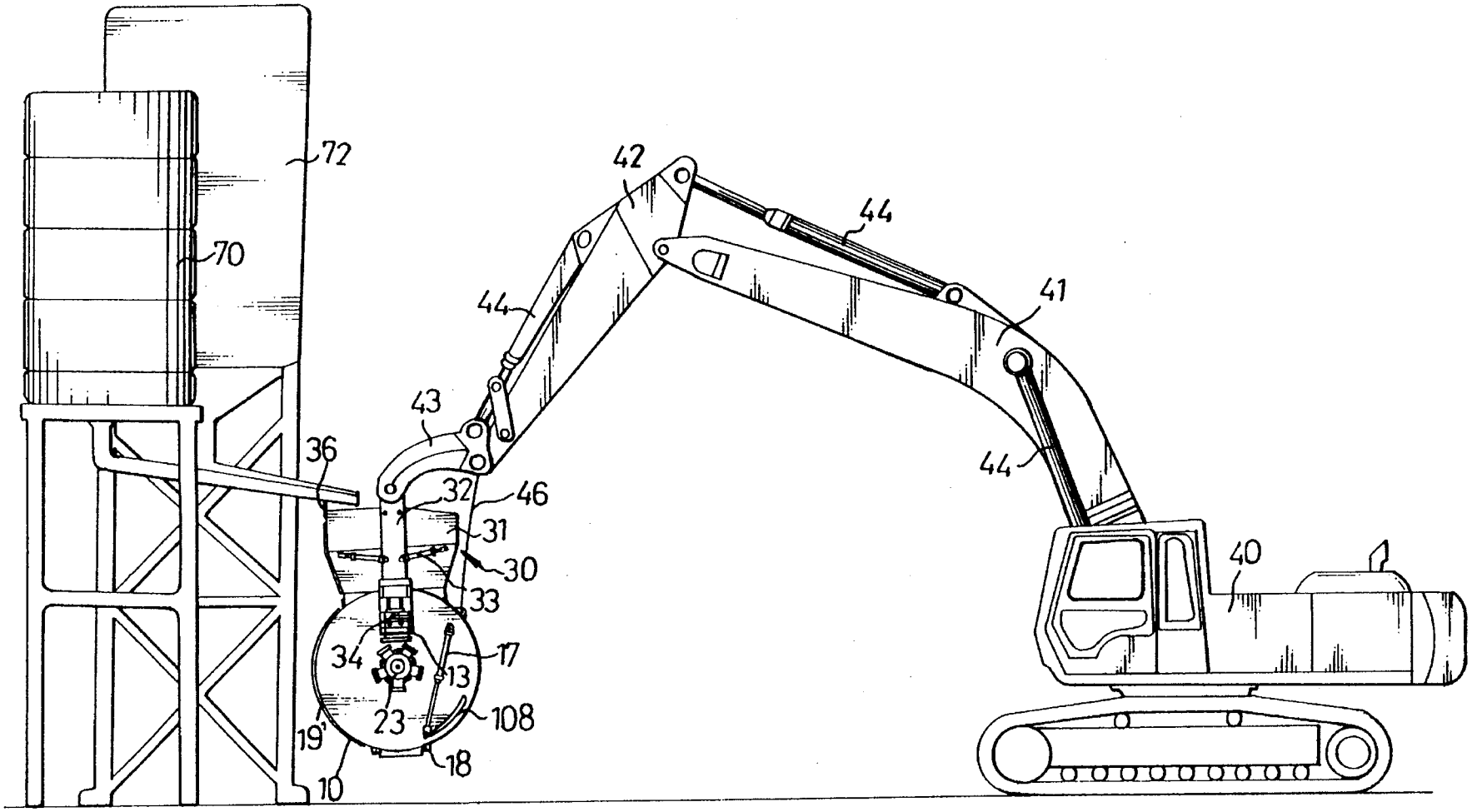
FIG. 8 is a side view showing that the excavator carrying the present cement mixer is moved adjacent to water and cement silos to receive water and cement therefrom.

Thereafter, as shown by FIG. 8, the excavator 40 is moved adjacent to cement and water supplying silos 70 and 72 to sequentially receive cement and water into the cement mixer in a manner like the operation to receive the gravel.

Figure 9:
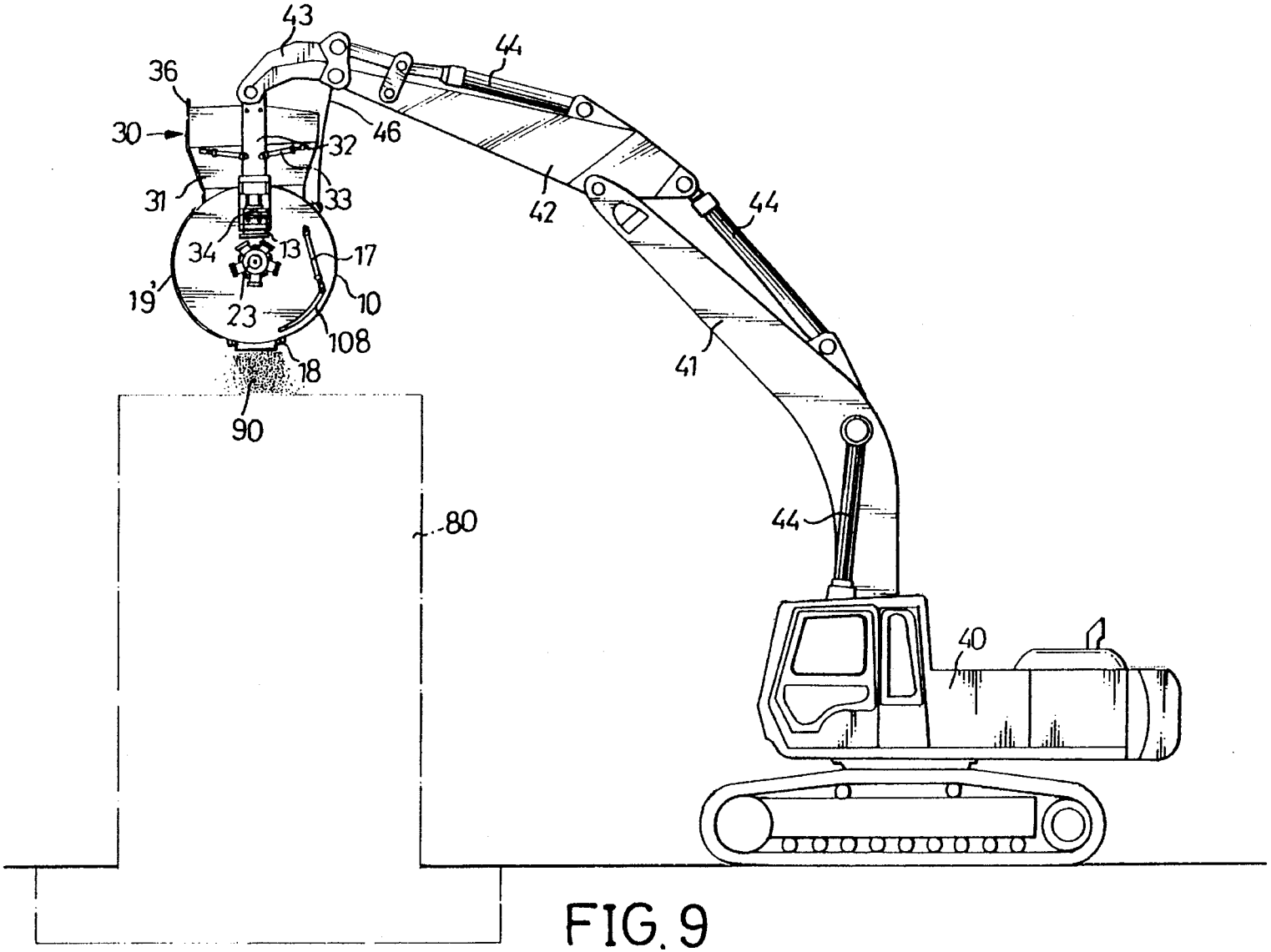
FIG. 9 is a side view showing that the excavator is moved adjacent to a casting site to pour mixed concrete into the same.

When all of the required materials (i.e., sand, gravel, cement and water) have been loaded into the accommodating chamber 102 with predetermined amounts, the driving motor 23 is driven to rotate the helical blade 22 to sufficiently agitate these materials, while the excavator 40 is moved adjacent to a casting site 80 as shown by FIG. 9. Then, the arm assembly of the excavator 40 is driven to lift the present cement mixer to be positioned above the casting site 80. Finally, the second valve 16 is driven to open the bottom opening 106 to allow the sufficiently mixed concrete to be poured into the casting site 80.

Figure 10:
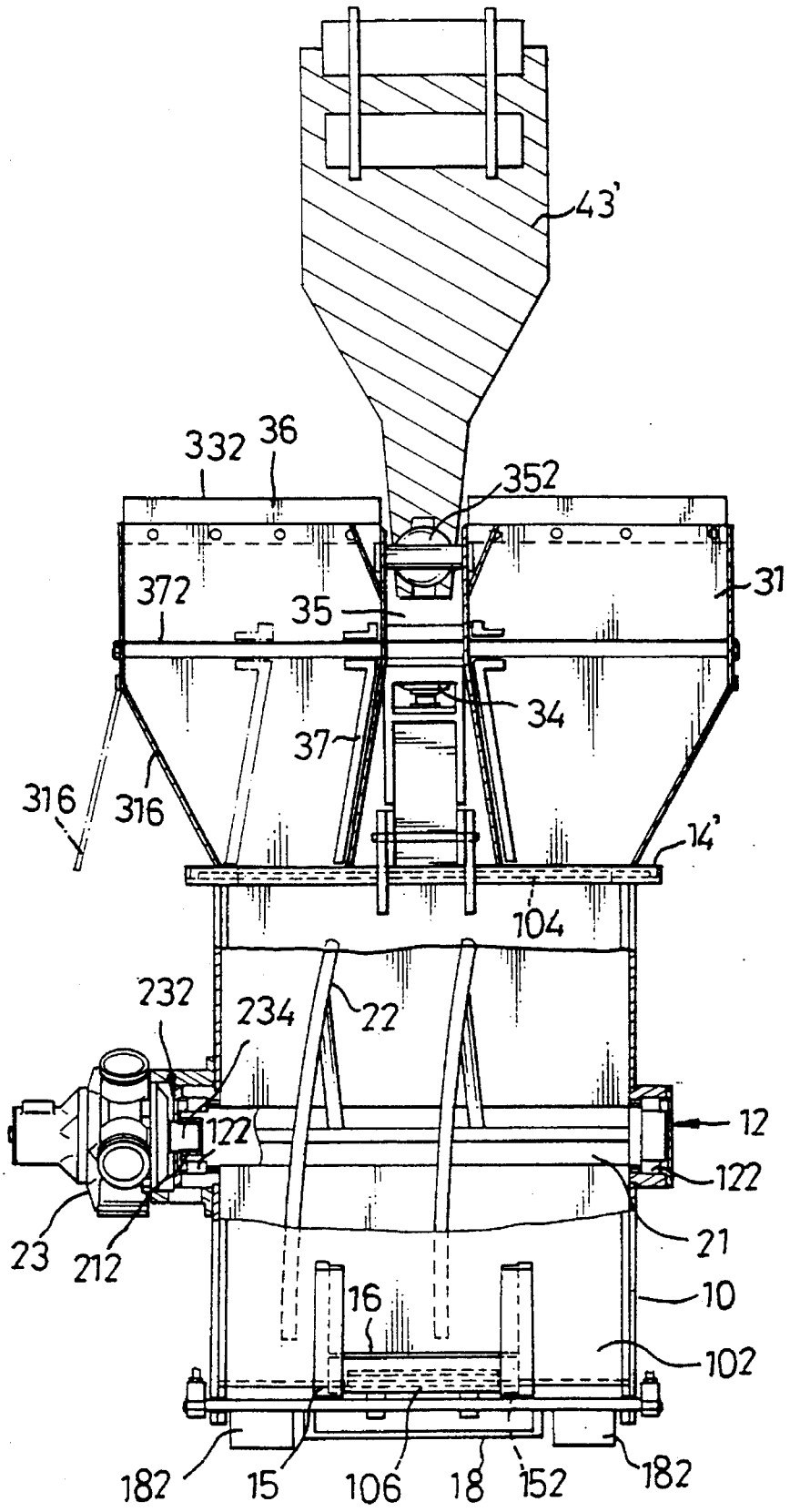
FIG. 10 is a front elevational, partly cross-sectional view showing another embodiment of the present cement mixer mounted on a linkage of an arm assembly of a heavy-duty machine.

FIG. 10 shows a modified embodiment of the present cement mixer, wherein a horizontal connecting beam 14' is provided at the top of the barrel 10. A vertical mounting beam 35 connects the beam 14' to a linkage 43' of the excavator 40 through a ball or universal joint 352, wherein the linkage 43' has a form other than that of the linkage 43. The weight measuring device 34 is mounted on the vertical mounting beam 35 and located between the ball joint 352 and the horizontal connecting beam 14'. In this embodiment, the funnels 31 are no longer pivoted by a driving of the cylinders 33. Rather, in this embodiment, the funnels are provided with doors 316 at their walls. The doors 316 are normally closed by a known means, for example, a spring loaded mechanism. A pair of rods 372 are provided to respectively transversely extend through the funnels 31. A pair of sand removing plates 37 are respectively provided in the funnels 31 and slideably mounted on the rods 372. After the sand has been loaded into the funnels 31 of the present embodiment in a manner like the description in reference to FIGS. 4 and 5, the sand removing plates 37 are driven to move along the rods 372 and toward the doors 316 by an action of a pair of hydraulic cylinders (not shown) connected with the plates 37. By the pushing force of the plates 37, in turn, the sand which has been loaded into the funnels 31 will push the doors and open them, whereby the superfluous sand in the funnels 31 can be evacuated therefrom.

Figure 11:
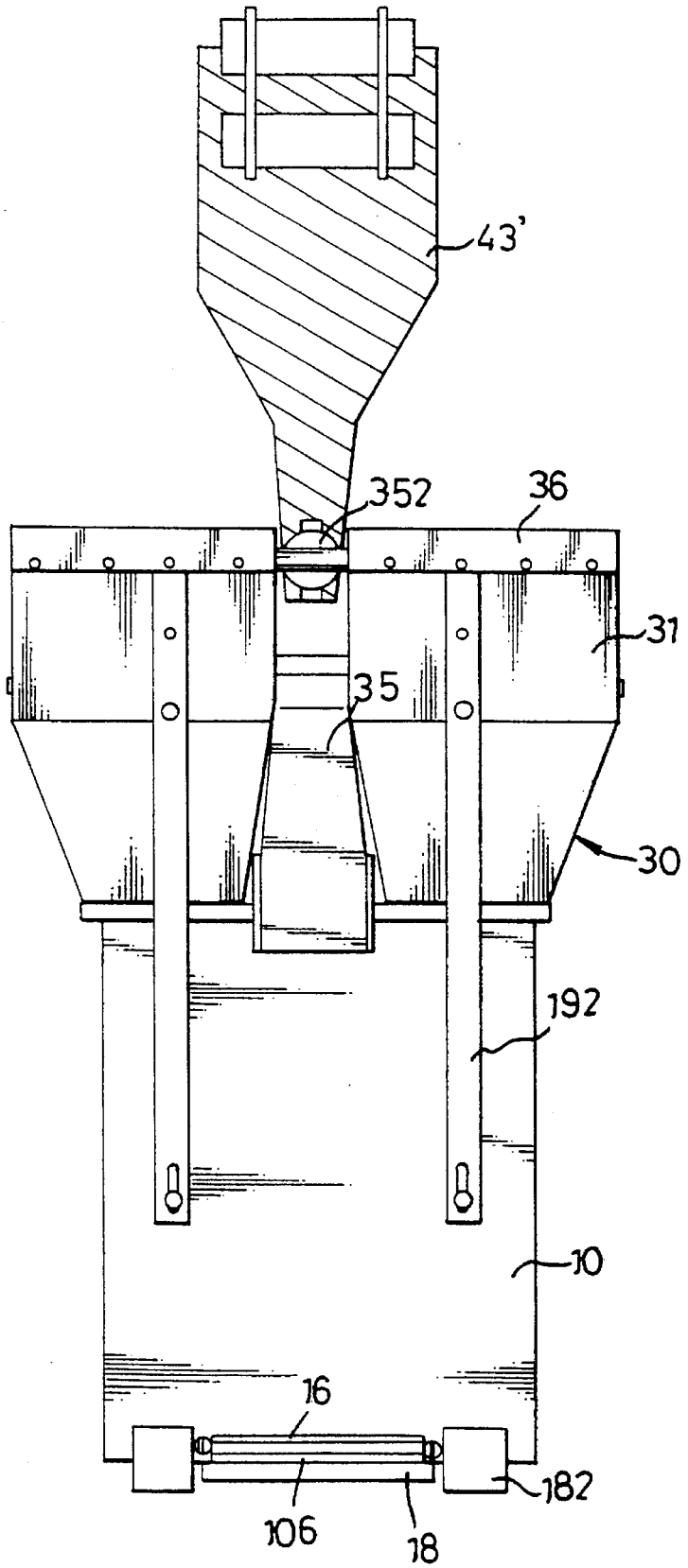
FIG. 11 is a front elevational view showing a further embodiment of the present cement mixer mounted on a linkage of an arm assembly of a heavy-duty machine.
Figure 12:
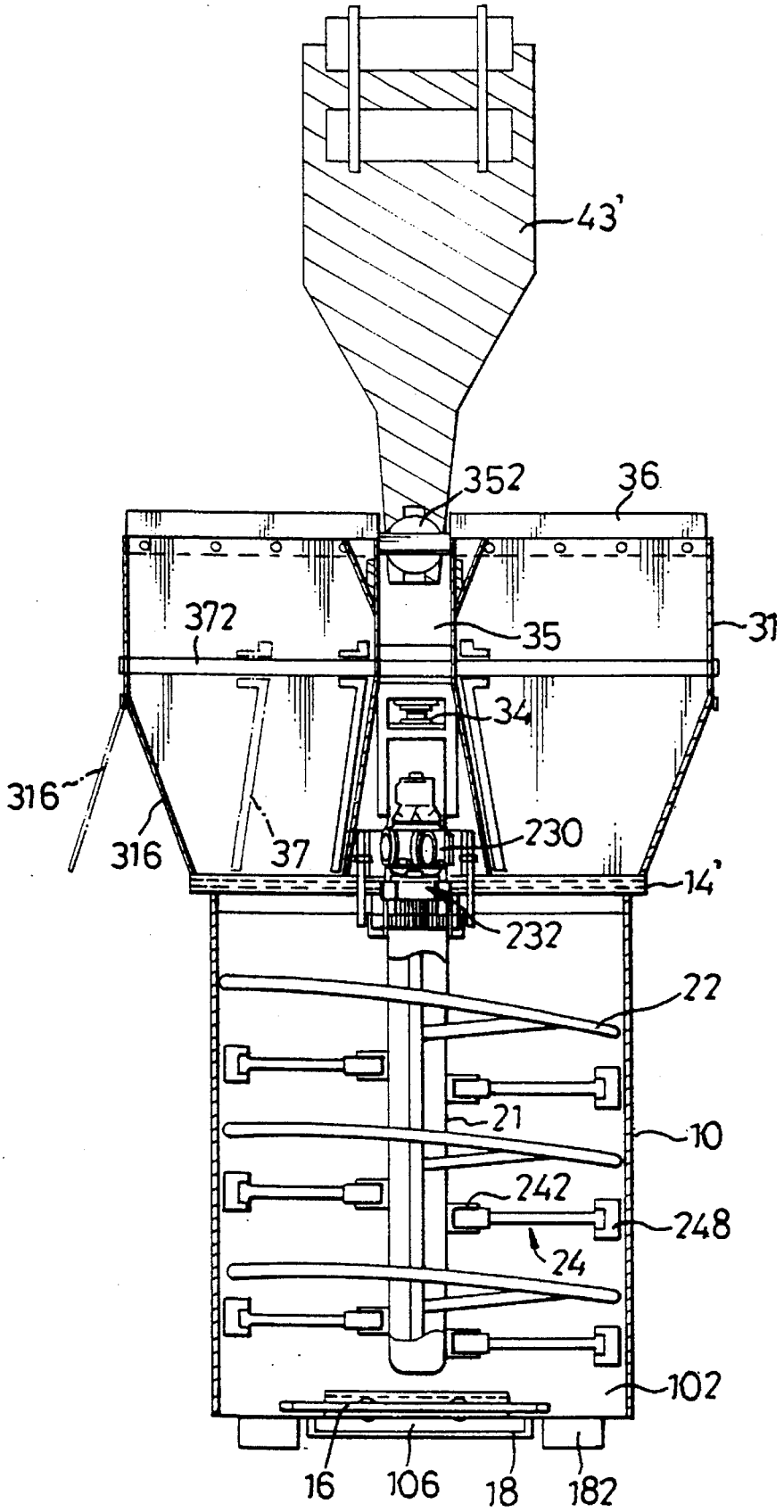
FIG. 12 is a cross-sectional view of FIG. 11 showing the inner structure of the embodiment of the cement mixer.

FIGS. 11 and 12 show a further modified embodiment of the present cement mixer wherein the agitator assembly is arranged to be vertically oriented with the driving motor 230 and the speed reduction mechanism 232 being mounted on the top of the barrel 10. The helical blade 22 extends vertically in the barrel 10. Furthermore, in this embodiment, the agitator assembly is additionally provided with a plurality of flexible wipers 24 fixedly attached to the shaft 21 and arranged alternatively with the helical blade 22. The details of the flexible blades 24 will be described in connection with FIG. 15. Particularly referring to FIG. 11, in this embodiment, the protective plates 19 and 19' of FIG. 1 are replaced by two parallel strips 192 mounted to extend from the shoveling plate 36 to an intermediate portion of the barrel 10 to protect the funnels 31 and the barrel 10.

Figure 13:
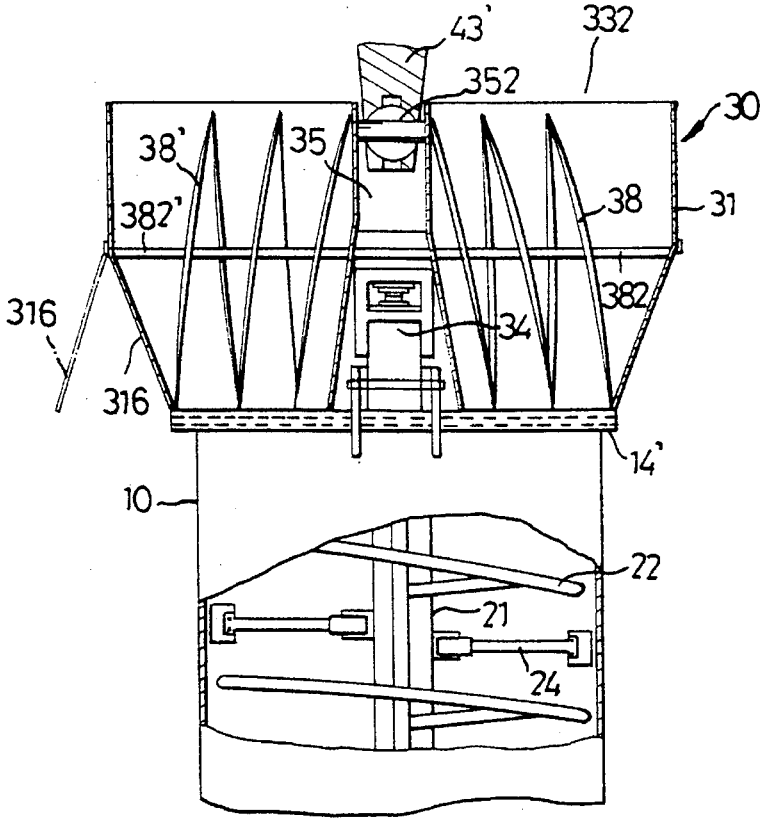
FIG. 13 is a front elevational view with a part cut away, showing a further embodiment of the present cement mixer wherein the funnels are equipped with helical guides.
Figure 14:
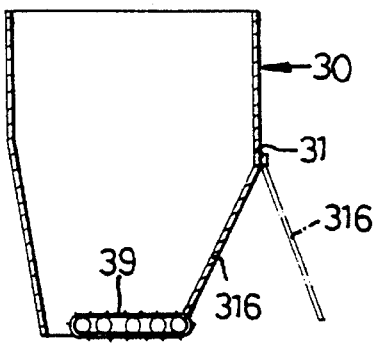
FIG. 14 is a front cross-sectional view showing a further embodiment of the funnel, which is equipped with a belt conveyor.

FIGS. 13 and 14 respectively show two possible mechanisms functioning similar to the function of the sand removing plates 37 of FIG. 10.

FIG. 13 shows that two helical guides 38, 38' with opposite spiral directions are respectively mounted in the funnels 31 and rotatable with two shafts 382, 382'. The shafts 382, 382' can be rotated by a known means, for example a motor through a transmission gear. When the helical guides 38, 38' are rotated, the sand in the funnels 31 will be moved following the spiral path of the guides 38, 38' to be expelled toward the door 316 thereby to open the door 316 and to evacuate the superfluous sand from the funnels 31.

FIG. 14 shows that a small belt conveyor 39 is mounted on a bottom of the right funnel 31 (the left funnel corresponding thereto). The belt conveyor 39 can be driven by a known means, for example, a motor through a transmission gear, to force the sand in the funnels 31 to move toward the door 316 thereby to open the door 316 and to evacuate the superfluous sand from the funnel 31.

Figure 15:
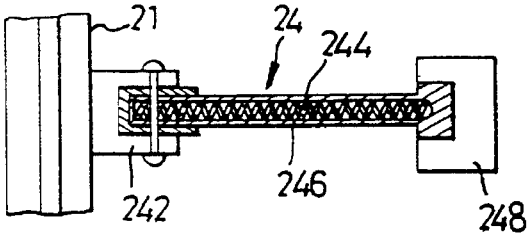
FIG. 15 is an enlarged view of FIG. 12, partly in cross-section, showing the details of a flexible blade.

FIG. 15 shows the detail of one of the flexible blades 24 of FIG. 12. Each of the flexible blades 24 includes a base portion 242 fixedly fastened to the shaft 21 by a known means, for example, screwing or welding; a strong spring 244 and a cover 246 formed of plastic or rubber and encasing the spring 244. The spring 244 has an end fixedly mounted on the base portion 242 and another end fixedly attached with a wiping plate 248 formed of abrasion-resistant plastic, wherein as shown by FIG. 12, the wiping plate 248 is located near an inner wall of the barrel 10. The flexible blades 24 are aimed to wipe concrete adhered on the inner wall of the barrel 10 thereby to improve the efficiency of mixing. Furthermore, the design of the flexible blades 24 has the following additional advantages: it generates little noise when operated, and even if there are small depressions on the cylindrical wall of the barrel 10 due to an impact thereof, the flexible blades 24 can still function well.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cement mixer mounted on a linkage of an arm assembly of a heavy-duty machine, comprising:

a barrel having a top opening for receiving materials to be mixed onto the barrel and a bottom opening for discharging mixed materials out of the barrel;

a first valve and a second valve mounted on the barrel for respectively controlling an opening and closing of the top and bottom openings;

an agitator assembly rotatably mounted in the barrel and used to agitate the materials to be mixed in the barrel;

a mounting beam connecting the barrel to the linkage;

a charging assembly mounted on the mounting beam and positioned above the barrel and used to receive the materials to be mixed and transferring a predetermined amount of the materials to be mixed into a barrel through the top opening thereof, a weight measuring device provided on the mounting beam and used to measure weight of the materials received in the charging assembly; and means for controlling the orientation of the cement mixer relative to the linkage.

2. A cement mixer according to claim 1, wherein the means comprises a steel rope having one end connected with the barrel and the other end adapted to be connected to a rotation generating mechanism.

3. A cement mixer according to claim 1, wherein the charging assembly comprises at least one funnel used to receive the materials to be mixed and pivotably mounted on the mounting beam and having an inlet and an outlet and at least a hydraulic cylinder connected with the mounting beam and the funnel for causing the funnel to pivot relative to the mounting beam between a first position and a second position, in the first position the outlet of the funnel being in alignment with the top opening of the barrel, and in the second position, the outlet of the funnel being in non-alignment with the top opening of the barrel to allow the materials received in the funnel to be evacuated from the cement mixer.

4. A cement mixer according to claim 1, wherein the charging assembly comprises at least one funnel used to receive the materials to be mixed and fixedly mounted on the mounting beam and having an inlet, an outlet in alignment with the top opening of the barrel, a door normally in a closed state and at least one sand removing plate slideably mounted in the funnel whereby when the sand removing plate is moved toward the door, the sand removing plate will force the materials received in the funnel to be evacuated from the cement mixer through the door.

5. A cement mixer according to claim 1, wherein the charging assembly comprises at least a funnel used to receive the materials to be mixed and fixedly mounted on the mounting beam and having an inlet, an outlet in alignment with the top opening of the barrel a door normally in a closed state and at least a helical guide rotatably mounted in the funnel, whereby when the helical guide is rotated, it will force the material received in the funnel to be evacuated from the cement mixer through the door.

6. A cement mixer according to claim 1, wherein the charging assembly comprises at least a funnel used to receive the materials to be mixed and fixedly mounted on the mounting beam and having an inlet, an outlet in alignment with the top opening of the barrel, a door normally in a closed state and at least a belt conveyor mounted in the funnel whereby when the belt conveyor is run, it will force the materials received in the funnel to be evacuated from the cement mixer through the door.

7. A cement mixer according to claim 1, wherein the charging assembly comprises a shoveling plate for shoveling the materials to be mixed into the charging assembly.

8. A cement mixer according to claim 7 further comprising a protective plate formed of an abrasion-resistant material and provided on the charging assembly and the barrel to protect the charging assembly and the barrel from abrasion when the cement mixer performs the shoveling operation.

9. A cement mixer according to claim 9 further the agitator asembly comprises a shaft extending through the barrel and a rigid helical blade fixedly attached to the shaft.

10. A cement mixer according to claim 9 further comprising a plurality of flexible blade assemblies alternatively mounted between the helical blade.

11. A cement mixer according to claim 10, wherein each of the flexible blade assemblies comprises a base portion fixedly attached to the shaft, a strong spring and a cover formed of plastic or rubber and encasing the spring said spring having an end fixedly mounted on the base portion and another end fixedly attached with a wiping plate formed of abrasion-resistant plastic, wherein the wiping plate is located near an inner wall of the barrel.

12. A cement mixer according to claim 1, further comprising a pair of cushioning pads and a supporting base mounted on a bottom of the barrel to help the cement mixer to be supported on a ground.

13. A cement mixer according to claim 1, wherein the weight measuring device is provided on the linkage.

14. A cement mixer according to claim 1, wherein the second valve is guided on a pair of L-shaped guiding rails beside the second valve, each guiding rail defining a guiding channel engaging a side of the second valve for the second valve to have a sliding movement thereon, one of the sides of the second valve further having a part formed with an ear at its end projecting therefrom to extend through an arcuate guiding slot defined on a side of the barrel, and wherein the cement mixer further comprising a hydraulic cylinder pivotally mounted on the side of the barrel where the arcuate guiding slot is defined, said hydraulic cylinder having a piston defining a connecting lug on an end thereof, said lug being fixedly connected with the ear of the second valve, whereby when the cylinder is extended or retracted, it can drive the second valve to move along the guiding rails thereby to close or open the bottom opening.

* * * * *